United States Patent [19]

Amici et al.

[11] Patent Number: 4,669,998

[45] Date of Patent: Jun. 2, 1987

[54] HUMANOID FIGURE ASSEMBLY AND METHOD FOR ASSEMBLING SAME

[75] Inventors: Francis R. Amici, Northford; Domenic G. Mercurio, Elmwood, both of Conn.

[73] Assignee: Coleco Industries, Inc., West Hartford, Conn.

[21] Appl. No.: 700,548

[22] Filed: Feb. 11, 1985

[51] Int. Cl.[4] ..... A63H 3/46

[52] U.S. Cl. ..... 446/383; 446/390

[58] Field of Search ..... 446/383, 376, 377, 378, 446/390, 381, 380, 379, 384

[56] References Cited

U.S. PATENT DOCUMENTS

| | | | |
|---|---|---|---|
| D. 221,008 | 6/1971 | Irons . | |
| D. 256,932 | 9/1980 | Jones et al. . | |
| D. 256,933 | 9/1980 | Jones et al. . | |
| D. 256,934 | 9/1980 | Jones et al. . | |
| D. 257,275 | 10/1980 | Jones et al. . | |
| D. 268,941 | 5/1983 | Lucas, Jr. et al. . | |
| 1,270,781 | 7/1918 | Cabana | 446/383 |
| 1,620,069 | 3/1927 | Bucherer | 446/375 |
| 1,859,175 | 5/1932 | Schaeffer | 446/373 |
| 2,118,677 | 5/1938 | Lower | 446/380 |
| 2,663,971 | 12/1953 | Ippolito | 446/384 |
| 3,277,602 | 10/1966 | Speers et al. | 446/380 |
| 3,566,534 | 3/1971 | Becker | 446/379 |
| 3,609,911 | 10/1971 | Hanf et al. | 446/376 |
| 3,628,282 | 12/1971 | Johnson et al. | 446/375 |
| 3,699,713 | 10/1972 | Sapkus et al. | 446/330 |
| 3,946,517 | 3/1976 | Goldfarb et al. | 446/383 |
| 3,988,855 | 11/1976 | Crabtree et al. | 446/380 |
| 4,030,239 | 6/1977 | White et al. | 446/321 |
| 4,120,117 | 10/1978 | Terzian et al. | 446/308 |
| 4,268,991 | 5/1981 | Cotey et al. | 446/373 |
| 4,274,224 | 6/1981 | Pugh et al. | 446/383 X |
| 4,286,407 | 9/1981 | Adickes, Jr. et al. | 446/375 |

FOREIGN PATENT DOCUMENTS

| | | | |
|---|---|---|---|
| 2604563 | 8/1977 | Fed. Rep. of Germany | 446/376 |
| 1386510 | 12/1964 | France | 446/381 |
| 35744 | 6/1935 | Netherlands | 446/383 |

*Primary Examiner*—Mickey Yu

[57] ABSTRACT

A simulated figure with articulated limbs and a pivotable head has a torso comprised of front and back sections which interfit to define a cavity and provide neck, arm and leg apertures. An armature is seated in the cavity and has arm and leg portions extending from a center portion to the arm and leg apertures and terminating in generally spherical elements. The upper ends of the arms and legs have generally spherical socket recesses which seat the spherical elements of the armature to provide pivotal movement in several axes. The legs have a pair of interfitting upper leg sections which provide a horizontal post in a slot at the lower end, and a lower leg member with a hinge projection seated on this post and pivotable thereabout in the slot. The figure may have an antennae structure including a base seated in the head cavity and a antennae extending outwardly through an aperture therein.

20 Claims, 8 Drawing Figures

HUMANOID FIGURE ASSEMBLY AND METHOD FOR ASSEMBLING SAME

BACKGROUND OF THE INVENTION

Articulated figure toys are old and well known and various techniques have been proposed for the fabrication and assembly of such toys. In the more sophisticated products, it is customary to provide joints at least at the arms and legs which will facilitate movement about more than one pivotal axis in order to allow movement of the limbs into various positions during the playing of games involving such figure toys. Similarly, it is customary to mount the head in a fashion which will allow it to pivot about a vertical axis relative to the torso at least to a limited degree.

In the fabrication of such toys, armatures of various types have been proposed to provide the means for recurring various of the limbs and/or the head to the torso of the structure of the simulated figure. Moreover, various techniques have been proposed for producing knee and elbow joints to allow relative motion between the upper and lower portions of these limbs.

It is an object of the present invention to provide a novel simulated figure in which legs, arms and head are provided with a high degree of relative movement and which may be assembled readily to provide a relatively sturdy assembly.

It is also an object to provide such a simulated figure in which the several components may be fabricated simply and at relatively low cost and in which means is provided for ensuring the desired alignment of various of the components during assembly.

Another object is to provide such a simulated figure in which antennae may be readily fabricated and mounted upon the head of the figure.

SUMMARY OF THE INVENTION

It has now been found that the foregoing and related objects may be readily attained in a simulated figure which includes a torso comprised of opposed front and back members defining a cavity therebetween, a neck aperture of generally circular cross-section, arm apertures of generally circular cross-section, and leg apertures of generally circular cross-section. The members of the torso have interfitting portions to facilitate their assembly, and there is seated in the cavity of the torso an armature which is comprised of a central portion extending generally vertically thereof, upper portions extending oppositely from the central portion to points to at least adjacent the arm apertures and lower portions extending oppositely from the central portion to points at least adjacent the leg apertures. These arm and leg portions each terminate in generally spherical elements.

A head has a neck portion of generally circular cross-section which extends through the neck aperture of the torso, and the head is hollow and pivotable relative to the torso about a generally vertical axis. Extending from the opposite sides of the torso are a pair of arms each of which has a socket recess of generally spherical configuration adjacent the upper end thereof which seats the spherical element of the arm portion of the armature to provide pivotal movement of the arm relative to the torso about several axes. A pair of legs extend from opposite sides of the torso and each has a lower leg portion and an upper leg portion. The upper leg portion has a socket recess of generally spherical configuration adjacent the upper end thereof which seats the spherical element of the leg portion of the armature to provide pivotal movement of the upper legs relative to the torso about several axes. The upper leg is comprised of a pair of interfitting sections the lower ends of which provide a transversely extending post and a downwardly opening slot thereabout. The lower leg has a knee hinge of reduced width at its upper end extending into the slot and an aperture therein which seats the post to provide pivotal movement of the lower leg about the post in the upper leg. Antennae extend from the head of the figure, and the antennae include a base portion in the cavity within the head and an elongated member extending outwardly of the head through the aperture. The base portion abuts the wall of the head about the aperture therethrough.

In the perferred embodiment, the sections of the upper leg portion is secured together and thereby secure the lower leg portion therein, and secure the leg in assembly on the torso. Conveniently, one of the upper leg sections has the post thereon, and the other upper leg section has a transversely extending pin seating in a recess in the post to facilitate secure assembly and alignment of the elements.

Desirably, the generally spherical elements on the armature have a slot extending partially therethrough to provide resilient compressibility of the outer end of the spherical elements for passage thereof into the socket recesses of the arms and legs during assembly of the figure. The neck portion of the head has a circumferential recess thereabout adjacent its lower end, and the torso has a rib portion on the wall defining the neck aperture to engage in the recess and permit controlled pivotal movement thereof. Most desirably, the figure includes a head locking member which has a cylindrical post extending into the neck portion from the body cavity and a collar at the lower end thereof. This post frictionally seats in the neck portion to provide a secure assembly of the head upon the torso.

The torso sections are assembled after insertion of the armature and neck portion of the head thereinto and are secured together to effect the secure assembly of the head upon the torso. In the preferred structures, the torso sections have interfitting elements thereon to effect alignment upon assembly thereof, and desirably these interfitting elements provide a pair of spaced posts with a bore therein on one section and a pair of pins on the other section which seat in the bores. To securely position the armature within the body cavity, the central portion of the armature has a pair of apertures therethrough, and the posts extend through these apertures to position the armature. To effect secure assembly, the torso sections, and the upper leg sections are bonded together after assembly. Conveniently, ultrasonic welding of the elements is employed to effect such bonding.

DETAILED DESCRIPTION OF THE ILLUSTRATED EMBODIMENT

Figure 1:
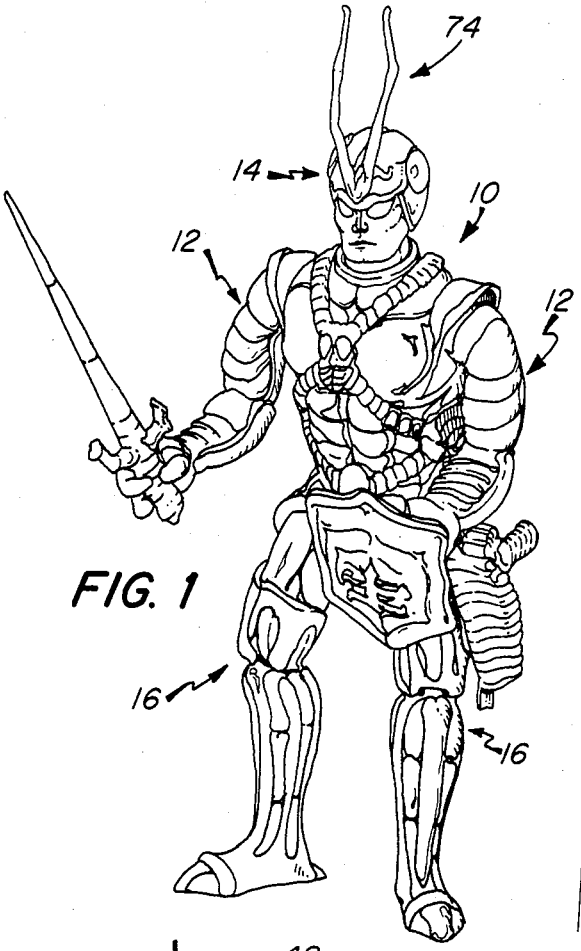
FIG. 1 is a perspective view of a simulated figure embodying the present invention.

Turning first to FIG. 1, therein illustrated is an assembled figure simulating a humanoid or science fiction character fabricated in accordance with the present invention. As seen, the figure comprises a torso generally designated by the numeral 10, a pair of arms generally designated by the numeral 12, a head generally designated by the numeral 14, a pair of legs generally designated by the numeral 16, and an antennae structure generally designated by the numeral 74.

Figure 2:
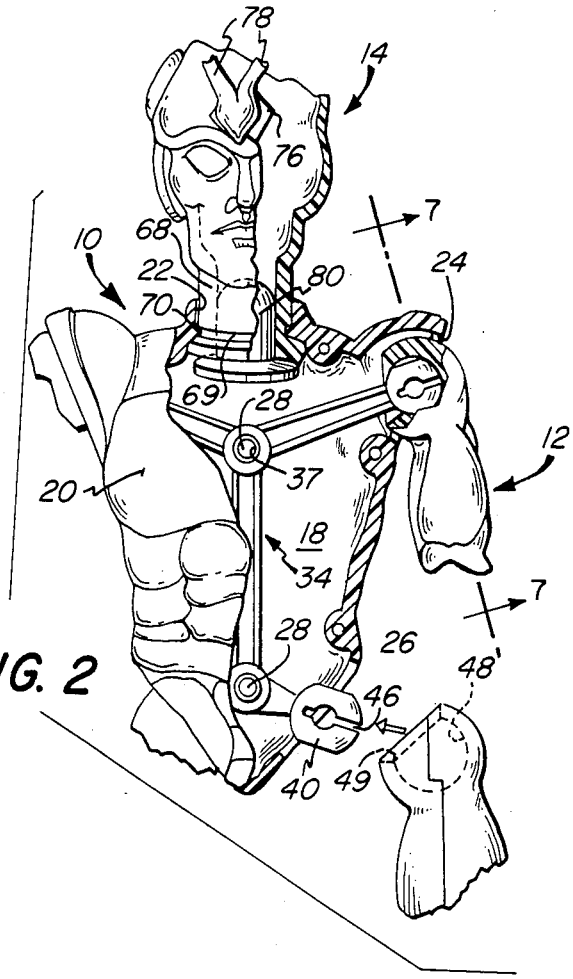
FIG. 2 is a fragmentary front elevational view thereof to an enlarged scale with portions broken away to reveal internal construction and with one fragmentarily illustrated leg disassembled from the armature.
Figure 5:
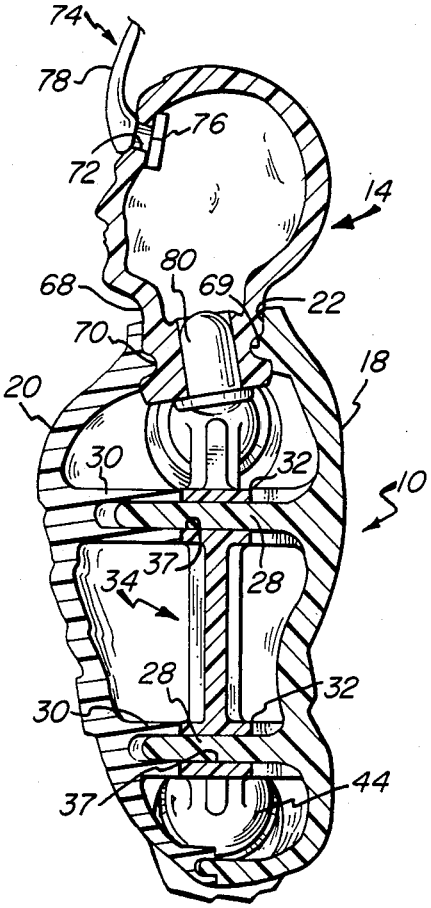
FIG. 5 is a fragmentary vertical sectional view of the figure.
Figure 7:
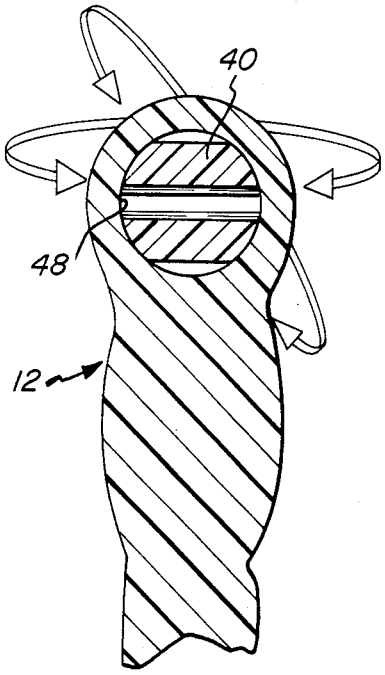
FIG. 7 is a fragmentary sectional view to a greatly enlarged scale along the line 7—7 of FIG. 2 illustrating by arrows some of the axes of rotation.

Turning next to FIGS. 2 and 5, it can be seen that the torso is comprised of a back section 18 and a front section 20 which are cooperatively configured to provide a neck aperture 22, arm apertures 24, and leg apertures 26. The back section 18 has a vertically spaced pair of posts 28 which seat in bores formed in an aligned pair of posts 30 formed on the front section 20. The posts 28 have radiating portions adjacent their bases which provide shoulders 32.

Figure 6:
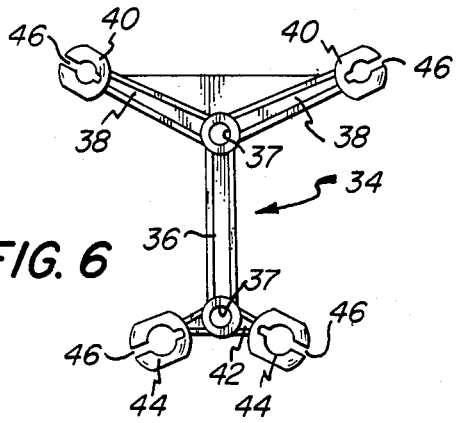
FIG. 6 is a front view of the armature.

Seated on the posts 28 tightly against the shoulders 32 is an armature generally designated by the numeral 34, and it is captured in this position by the post 30 on the front section 20 following its assembly. As best seen in FIG. 6, the armature 34 has a central portion 36 which extends generally vertically of the torso 10 and which has a pair of apertures 37 adjacent its upper and lower ends through which the posts 28 extend. Extending outwardly and upwardly from the center portion 36 are a pair of arm portions 38 with a reinforcing or connecting web extending therebetween along a portion of their length. The arm portions 38 terminate in generally spherical elements 40 for a purpose to be described more fully hereinafter. Extending outwardly and downwardly from the center portion 36 are a pair of leg portions 42 which terminate in generally spherical elements 44. The spherical elements 40 and 44 are both provided with slots 46 extending inwardly thereinto from the outer ends thereof to provide resilient compressibility of the outer end portions thereof.

Figure 3:
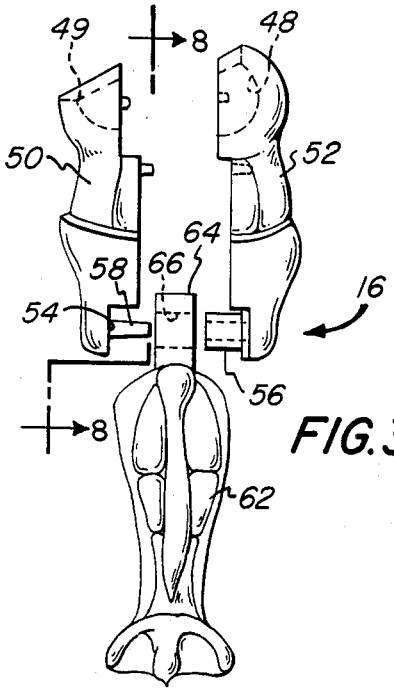
FIG. 3 is a front exploded view of a leg.

Each leg 16 has a generally spherical socket recess 48 opening at the upper end thereof in which is slidably seated a spherical element 40. As seen in FIGS. 2 and 3, the spherical recess 48 is greater than a hemisphere so as to provide a shoulder 49 of a width less than the diameter of the spherical recess 48. As a result, upon pressing the legs 16 onto the elements 40 during assembly, the leg 16 will cause the spherical element 40 to compress in the area of the slot 46 and, upon resilient deflection of the spherical element 40 to the uncompressed position, the leg 16 will be firmly seated on the armature 34.

Each leg 16 is comprised of a lower leg 62 and a pair of upper leg sections 50,52 which interfit and are bonded together. As can be seen in FIGS. 2 and 3, the sections 50,52 are cooperative configured to provide the spherical socket recess 48 at the upper end thereof. At their lower end, the sections 50,52 are configured to provide a generally vertically extending slot 54 opening at the bottom thereof. The element 52 is configured to provide a horizontally extending post 56 with a bore therein, and the section 50 is configured to provide a horizontally extending pin 58 which seats in the bore in the post 56.

Figure 8:
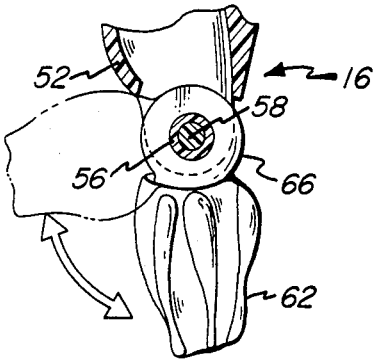
FIG. 8 is a fragmentary sectional view of a leg along the line 8—8 of FIG. 3 showing the assembly and rotation of the upper and lower leg members.

The lower leg 62 has a reduced width hinge portion 64 extending upwardly at its upper end which is dimensioned and configured to fit within the slot 54. The hinge portion 64 has an aperture 66 extending therethrough which seats the post 56 to provide the pivotal mounting thereof to the upper leg sections 50,52. As seen in FIG. 8, the hinge portion 64 is of generally circular configuration and is freely pivotable in the slot 54 about the horizontal axis defined by the post 56.

As will be readily appreciated, the lower leg 62 is assembled to the post 56 of the upper leg section 52 and then, when the upper leg section 50 is assembled thereto, this traps the lower leg 62 in assembly. The sections 50,52 of the upper leg are then bonded together to firmly secure the leg components in assembly.

Turning now to the configuration and mounting of the head 14 as seen in FIGS. 2 and 5, it can be seen that the head 14 is hollow and has a neck portion 68 of generally circular cross-section which extends through the neck aperture 22 into the cavity defined within the torso sections, 18,20. The neck position 68 is provided with a circumferentially extending recess 70 adjacent its lower end, and the wall of the torso sections 18,20 about the neck aperture 22 is provided with a rib 70 extending thereabout which seats in the recess 69. Extending upwardly into the neck portion 66 from the torso cavity is a neck plug 80 with a generally cylindrical post section and an enlarged collar at the lower end of the neck portion 68. As will be appreciated, the neck portion 68 of the head 14 is inserted into the neck aperture 22 of the back section 18, and the neck plug 80 is then inserted thereinto. Upon assembly of the front section 20, the head 14 is therefore trapped securely on the torso 10 although freely pivotable about a vertical axis.

Figure 4:
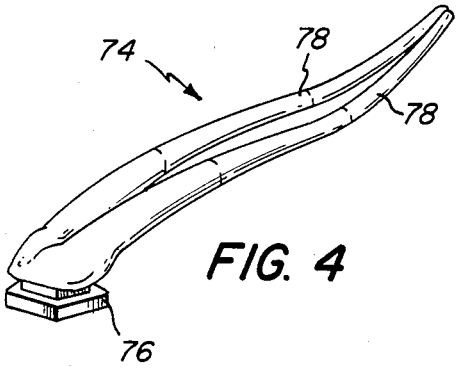
FIG. 4 is a perspective view of the antennae assembly prior to mounting within the figure.

As seen in FIG. 5, the head 14 has an aperture 72 extending therethrough. The antennae assembly 74 prior to its insertion into the head is seen in FIG. 4 and includes a base 76 and a pair of elongated antennae elements 78 which are attached at their outer ends. The base 76 includes a portion of reduced cross-section dimensioned cooperatively with the thickness of the wall defining the head 14 as seen in FIG. 5. Prior to assembly of the head 14 upon the torso 10, the antennae assembly 74 seen in FIG. 4 is inserted into the cavity of the head 14 and the antennae 78 are pressed through the aperture 72 until the base 76 seats against the wall of the head 14 about the aperture 72. Although the antennae assembly 74 may be frictionally retained in position, adhesive or other bonding may also be employed. Following assembly, the two antennae elements 78 are separated to space their outer ends apart as seen in FIG. 1.

The arms 12 are similarly assembled onto the spherical elements 40 of the armature by pressing the upper ends of the arms 12 to compress the spherical elements 40 about the slots 46 until the spherical elements 40 seat in the spherical sockets 82 at the upper end of the arms 12.

As will be readily appreciated, the various components of the figure are fabricated from synthetic resin, and they can be bonded together as required by separate adhesive application, or by use of ultrasonic welding or similar techniques to produce a bonding interface therebetween. Moreover, to facilitate the assembly of the elements in proper alignment, interfitting locating elements other than those specifically described may be provided upon the components which mate together, such as the bosses with projections and interfitting recesses on similar bosses seen in FIGS. 2, 3 and 5 bosses.

In the process of assembling the illustrated embodiment, the antennae assembly 74 is first assembled to the head 14, and the head 14 is then assembled into the back section 18. The neck plug 80 is then inserted thereinto.

In the next step, the armature 34 is seated on the posts 28 firmly against the shoulders 32 thereon. Each lower leg 62 is seated on the post 56 of the upper leg section 52, and the upper leg section 50 is then seated in interfitting relationship with the section 52 to capture the lower leg 62 therebetween. The upper leg elements 50,52 are then bonded together. The front section 20 is then assembled onto the back section 18 in the fashion seen in FIG. 5, and the two sections are secured in assembly. The arms 12 and legs 16 may then be assembled to the spherical elements 40,44 of the armature 34 by pressing them firmly onto the spherical elements 40,44 to compress the element about the slots 46 until the spherical elements 40,44 seat in the sockets 48 and 82 respectively.

Thus, it can be seen from the foregoing detailed specification and the attached drawings, that the simulated figure of the present invention is one which may be readily fabricated and relatively easily assembled. The final structure is one which offers a relatively durable assembly with a relatively high degree of long lived articulation.

Having thus described the invention, what is claimed is:

1. A simulated figure comprising:

A. a torso comprised of opposed front and back members defining a cavity therebetween, a neck aperture of generally circular cross section, arm apertures of generally circular cross section and leg apertures of generally circular cross section, said members of said torso having interfitting portions;

B. an armature seated in said cavity of said torso and having a central portion extending generally vertically thereof, arm portions extending oppositely from said central portion to points at least adjacent said arm apertures, leg portions extending oppositely from said central portion to points at least adjacent said leg apertures, said arm and leg portions terminating in generally spherical elements;

C. a head having a neck portion of circular cross section extending through said neck aperture of said torso, said head being hollow and pivotable within said torso about a generally vertical axis;

D. a pair of arms each having a socket recess of generally spherical configuration adjacent the upper end thereof, said socket recesses seating said spherical elements of said arm portions of said armature to provide pivotal movement of said arms relative to said torso about several axes;

E. a pair of legs each having a lower leg portion and an upper leg portion, said upper leg portions having a socket recess of generally spherical configuration adjacent the upper end thereof, said socket recesses seating said spherical elements of said leg portions of said armature to provide pivotal movement of said upper legs relative to said torso in several axes, said upper leg portions being comprised of a pair of interfitting sections, the lower ends of said sections providing a transversely extending post and a downwardly opening slot thereabout, said lower leg portion having a knee joint of reduced width extending into said slot and an aperture therein seating said post to provide pivotal movement about said post; and F. an antennae structure extending outwardly from said head, said antennae structure including a base portion in the cavity within said head abutting the wall thereof about an aperture therethrough and an elongate member extending outwardly of said head through said aperture.

2. The simulated figure of claim 1 wherein said sections of said upper leg portion are secured together and thereby secure said lower leg portion thereto and secure said leg in assembly on said torso.

3. The simulated figure of claim 1 wherein one of said upper leg sections has said post thereon and the other leg section has a transversely extending pin seating in a recess in said post to facilitate secure assembly and alignment thereof.

4. The simulated figure of claim 1 wherein said generally spherical elements of said armature have a slot extending partially therethrough to provide resilient deflectability of the outer ends of said elements for passage into said socket recesses of said arms and legs.

5. The simulated figure of claim 1 wherein said neck portion of said head has a circumferential recess thereabout adjacent its lower end and said torso has a rib portion on the wall defining said neck aperture to engage in said recess and permit controlled pivotal movement thereof.

6. The simulated figure of claim 5 wherein there is included a head locking member having a cylindrical post extending upwardly into said neck portion and a collar at the lower end thereof.

7. The simulated figure of claim 6 wherein said post frictionally seats in said neck portion.

8. The simulated figure of claim 5 wherein said torso sections are assembled after insertion of said armature and neck portion of said head thereinto and are secured together to effect the secure assembly thereof.

9. The simulated figure of claim 1 wherein said torso sections have interfitting elements thereon to effect alignment upon assembly thereof.

10. The simulated figure of claim 9 wherein said interfitting elements comprise a pair of spaced posts with a bore therein on one section and a pair of pins on the other section seated in said bores.

11. The simulated figure of claim 10 wherein said armature has a pair of apertures extending through its center portion and said posts extend through said apertures to position said armature in said torso cavity.

12. The simulated figure of claim 1 wherein said torso sections are bonded together and upper leg sections are bonded together.

13. The simulated figure of claim 11 wherein said torso sections and upper leg sections are ultrasonically welded.

14. A simulated figure comprising:

(a) a torso comprised of opposed front and back rigid members defining a cavity therebetween, a neck aperture of generally circular cross section, arm apertures of generally circular cross section and leg apertures of generally circular cross section, said members of said torso having interfitting elements thereon to effect alignment upon assembly thereof, said interfitting elements comprising a pair of spaced posts with a bore therein on one section and a pair of pins on the other section seated in said bores, said torso members being bonded together;

(b) a rigid armature rigidly seated in said cavity of said torso and having a generally rectilinear central portion extending vertically thereof, arm portions extending oppositely from adjacent the upper end of said central portion to points adjacent said arm apertures, leg portions extending oppositely from adjacent the lower end of said central portion to points adjacent said leg apertures, said arm and leg portions terminating in socket elements with a generally spherical surface portion, said armature having a pair of apertures extending through its central portion with said posts of said torso members extending through said apertures to position said armature in said torso cavity;

(c) a head having a neck portion of circular cross section extending through said neck aperture of said torso, said head being hollow and pivotable within said torso about a generally vertical axis;

(d) a pair of arms extending inwardly of said arm apertures and each having a socket recess of generally spherical configuration adjacent the upper end thereof, said socket recesses encircling and seating said socket elements of said arm portions of said armature to provide pivotal movement of said arms relative to said torso about several axes; and (e) a pair of legs extending inwardly of said leg apertures and each having a lower leg portion and an upper leg portion, said upper leg portions having a socket recess of generally spherical configuration adjacent the upper end thereof, said socket recesses encircling and seating said socket elements of said leg portions of said armature to provide pivotal movement of said upper legs relative to said torso in several axes, said upper leg portions being comprised of a pair of interfitting sections formed of relatively rigid material and bonded together along their side margins to provide a closed leg-like configuration, the upper ends of said sections cooperatively defining said socket recess, and the lower ends of said sections providing a transversely extending post and a downwardly opening slot thereabout, said lower leg portion having a knee joint of reduced width extending into said slot and an aperture therein seating said post to provide pivotal movement about said post, said sections of each upper leg portion being secured together to thereby secure said lower leg portion thereto and secure said leg in assembly on said torso.

15. The simulated of claim 14 wherein one of said upper leg sections has said post thereon and the other leg section has a transversely extending pin seating in a recess in said post to facilitate secure assembly and alignment thereof.

16. A simulated figure comprising:

(a) a torso comprised of opposed front and back rigid members defining a cavity therebetween, a neck aperture of generally circular cross section, arm apertures of generally circular cross section, and a pair of leg apertures of generally circular cross section, said toso members having interfitting elements thereon to effect alignment upon assembly thereof and comprised of at least one post with a bore therein on one member and a pin on the other member seated in said bore;

(b) a rigid armature fixedly seated in said cavity of said torso and having a generally rectilinear central portion and leg portions extending oppositely from adjacent the lower end of said central portion to points adjacent said leg apertures and terminating in socket elements with a generally spherical surface portion, said armature having at least one aperture extending through its central portion, said post of said torso member extending through said aperture to position fixedly said armature in said torso cavity;

(c) a pair of legs extending inwardly of said apertures and each having a lower leg portion and an upper leg portion, said upper leg portions each having a socket recess of generally spherical configuration adjacent the upper end thereof, said socket recesses encircling and seating said socket elements of said leg portions of said armature to provide pivotal movement of said upper legs relative to said torso in several axes, said upper leg portions being comprised of a pair of interfitting sections formed of relatively rigid material and bonded together along their side margins to provide a closed leg-like configuration, the upper ends of said sections cooperatively defining said socket recess and the lower ends of said sections providing a transversely extending post and a downwardly opening slot thereabout, said lower leg portion having a knee joint of reduced width extending into said slot and an aperture therein seating said post to provide pivotal movement about said post, said sections of said upper leg portion being secured together to thereby secure said lower leg portion thereto and secure said leg in assembly on said torso;

(d) a head having a neck portion of circular cross section extending through said neck aperture of said torso and being pivotable therein about a generally vertical axis; and (e) a pair of arms having their upper ends extending through said arm apertures of said torso and pivotable therein.

17. The simulated of claim 16 wherein one of said upper leg sections has said post thereon and the other leg section has a transversely extending pin seating in a recess in said post to facilitate secure assembly and alignment thereof.

18. The simulated figure of claim 16 wherein said socket elements of said armature have a slot extending partially therethrough to provide resilient deflectability of the outer ends of said socket elements for passage into said socket recesses of said legs.

19. In a method of producing a simulated figure, the steps comprising:

(a) forming a pair of rigid torso members with a configuration defining a cavity therebetween and with neck, arm and leg apertures of generally circular cross section, said torso members having interfitting elements thereon to effect alignment upon assembly thereof and comprised of at least one post with a bore therein on one member and a pin on the other member adapted for seating in said qore;

(b) forming a rigid armature having a generally rectilinear central portion and leg portions extendng oppositely from adjacent the lower end of said central portion and terminating in socket elements with a generally spherical surface portion, said armature having at least one aperture extending through its central portion adapted to receive therethrough said post of said one torso member;

(c) forming rigid leg elements for a pair of legs, said elements of each leg includng a first pair of interfitting sections cooperatively providing an upper leg portion in which is cooperatively defined a socket recess of generally spherical configuration at the upper end thereof and, at the lower end thereof, a transversely extending post and a downwardly opening slot thereabout, said leg elements additionally including a lower leg portion having a knee joint of reduced width dimensioned to extend into said slot with an aperture therein adapted to seat said post, said leg elements being formed of relatively rigid material;

(d) assembling said leg elements by seating said post of one section of the upper leg sections in said aperture in said knee joint of said lower leg portion and then assembling the other section to produce the legs;

(e) bonding the assembled sections of said upper leg elements along their side margins to provide a closed leg-like configuration and capture the lower leg portion therewithin;

(f) inserting said armature into said one torso member with said post thereof extending through said armature aperture and with said socket elements adjacent said leg apertures, and assembling said other torso member thereto;

(g) bonding the assembled torso members along their side margins to define a rigid torso-like portion of the simulated figure capturing said armature;

(h) mounting said legs by inserting said socket elements of said armature into said spherical recesses thereof to seat said socket elements therewithin; and (i) inserting a head member having a neck portion of generally circular cross section into said neck aperture of said torso members.

20. The method in accordance with claim 19 wherein said torso members are formed to define a pair of arm apertures of generally circular cross section, wherein said armature is formed to have a pair of arm portions extending oppositely from said central portion spaced from said leg portions thereof and terminating in generally spherical elements; and wherein there are included the steps of forming a pair of arms, each having a socket recess of generally spherical configuration adjacent the upper end thereof, and for inserting said arms into said arm apertures on said torso to seat said spherical elements of said armature arm portions within said recesses of said arms, and thereby to mount said arms.

* * * * *